United States Patent [19]

Ikeura et al.

[11] Patent Number: 4,776,106

[45] Date of Patent: Oct. 11, 1988

[54] DRYER FOR PHOTOSENSITIVE MATERIAL

[75] Inventors: Hiroo Ikeura; Yuji Hayashi, both of Wakayama, Japan

[73] Assignee: Noritsu Kenkyu Center Co., Ltd., Wakayama, Japan

[21] Appl. No.: 64,425

[22] Filed: Jun. 22, 1987

[30] Foreign Application Priority Data

Jun. 23, 1986 [JP] Japan ..... 61-96600[U]

[51] Int. Cl.[4] ..... F26B 13/00

[52] U.S. Cl. ..... 34/155; 34/162

[58] Field of Search ..... 34/155, 162

[56] References Cited

U.S. PATENT DOCUMENTS 2,563,666 8/1951 Veyset et al. ..... 34/162 X
2,737,100 3/1956 Horn ..... 34/162 X
3,867,767 2/1975 Wright ..... 34/155
4,124,942 11/1978 Ohls et al. ..... 34/155 X

FOREIGN PATENT DOCUMENTS 2122322 1/1984 United Kingdom ..... 34/155

*Primary Examiner*—Steven E. Warner
*Attorney, Agent, or Firm*—Armstrong, Nikaido, Marmelstein & Kubovcik

[57] ABSTRACT

A web of photosensitive material fed into a drying chamber is carried on an endless conveyer belt hanging in a U-shape in contact with and guided along a U-shaped belt guide. Hot air is blown out of a duct arranged within the U-shaped belt guide to dry the material and press it against the surface of the conveyer belt. Thus, the material is carried by the belt conveyer smoothly without suffering any damages on its surface due to rubbing against guide members.

3 Claims, 1 Drawing Sheet

DRYER FOR PHOTOSENSITIVE MATERIAL

The present invention relates to a device for drying a web of photosensitive material.

In a conventional drying device of this type, a web of photosensitive material such as a developed film or photoprinted paper is inserted into a drying chamber from its top, inverts its running direction at the bottom of the drying chamber, taking a U-shaped path to effectively use the area for drying.

As shown in FIG. 3, in a drying chamber 21 of a conventional dryer of this type, a web of photosensitive material A is fed down on a circulating conveyer belt 23 while being exposed to the air from a duct 28 to be dried. The photosensitive material A then passes between a turn roller 24 and a plurality of pressure rollers 25 at the bottom, and after turning its direction, and goes up between pressure rollers 26 disposed in two or more pairs. The material ascends with both edges thereof supported by belt-like V-shaped guide members 22. The material thus dried is then led to between a turn roller 29 and a plurality of pressure rollers 30 and is delivered to the following station which is a cutter unit 31.

With such a conventional device, a web of material is fed between the turn roller and a plurality of pressure rollers and is fed in contact with the pressure rollers and the belt-like V-shaped guide member for a long distance. As a result, the web surface is liable to damage by its contact with a variety of members. If the incompletely dried photosensitive material is pressed against the pressure rollers, the pressure may cause damage or form uneven surface on the material. In addition, while the incompletely dried material is being fed, supported by the belt-like V-shaped guide member, it may accidentally adhere thereto. Furthermore, due to the presence of the pressure rollers and the V-shaped guide member, the material may be dried unevenly. Consequently, it was quite difficult with such a conventional dryer to uniformly dry the photosensitive material over its whole length.

An object of the present invention is to provide a dryer which obviates the problems mentioned above and which allows the material to smoothly turn its moving direction and assure smooth movement of the material for effective drying.

In accordance with the present invention, there is provided a dryer for a web of photosensitive material comprising a drying chamber, a U-shaped belt guide mounted in the drying chamber, an endless conveyor belt guided to run along and in contact with the inner side of the U-shaped belt guide for transporting the web of photosensitive material, and a drying air duct arranged within the U-shaped belt guide and formed with a plurality of ports for jetting air against the surface of the web in contact with the conveyor belt.

The conveyer belt descends under its own weight into contact with the U-shaped belt guide. As a result, the conveyer belt takes a U-shape configuration which is an ideal travelling path of the photosensitive material to allow the conveyer belt to circulate with the rotation of pulley with part of the belt being in contact with the belt guide. With the movement of the conveyer belt, the air duct blows out air against the surface of the conveyer belt. After being inserted into the drying chamber from the upper inlet, the material remains pressed against the surface of the conveyer belt by the drying air. As the conveyer belt runs, normal drying process is executed by applying a dry air. The photosensitive material then smoothly turns its direction at the bottom of the drying chamber while being pressed against the conveyer belt. Then, the material ascends through the drying chamber and is smoothly passed to the following station.

After placing the photosensitive material on the surface of the conveyer belt, the dryer of the present invention positively uses the pressure generated by the wind for drying the material in order that the material can be smoothly fed with the movement of the conveyer belt. In particular, since the material smoothly shifts its moving direction at the bottom in the drying chamber, the dryer securely prevents the material from being damaged on its surface. Furthermore, it prevents the material from uneven drying and also from any potential fault caused by accidental adhesion to the mechanical components.

In other words, it is free from the shortcomings resulting from forced feeding by means of guide frames and pressure rollers as in the conventional device.

As a result, the drying device of the present invention can smothly, quickly and effectively dry and transport the photosensitive material. In addition, since it does not require guide frame and pressure rollers, the mechanical construction can extremely be simplified, thus reducing the cost of the device itself.

Other features and objects of the present invention will become apparent from the following description taken with reference to the accompanying drawings, in which.

Figure 1:
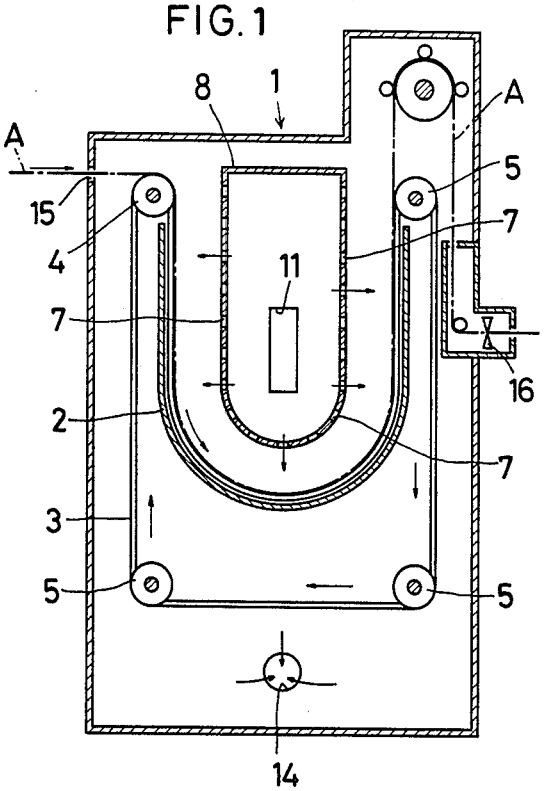
FIG. 1 is a vertical sectional front view of the dryer for a web of photosensitive material embodying the present invention.
Figure 2:
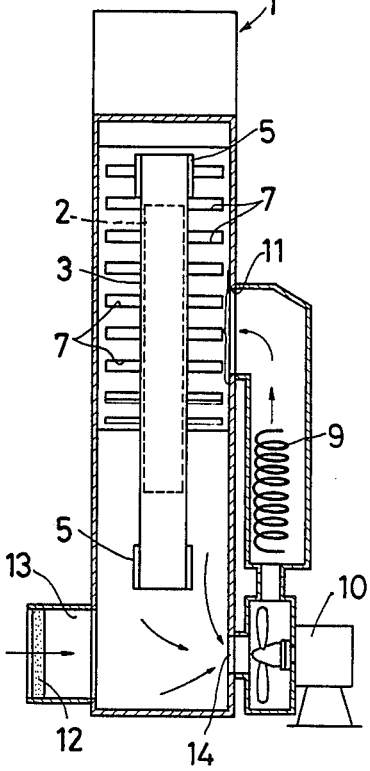
FIG. 2 is a left side view of the dryer of FIG. 1 with its side wall removed.
Figure 3:
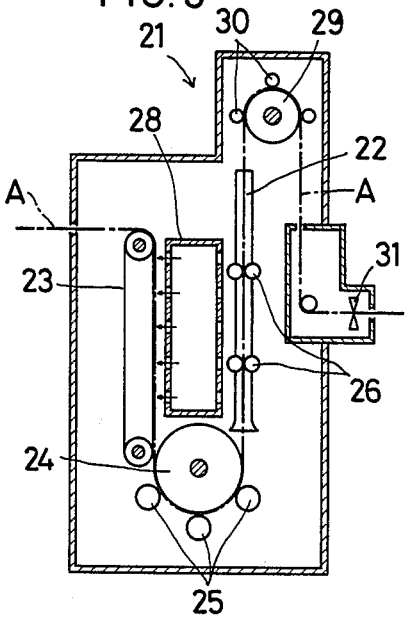
FIG. 3 is a diagrammatic vertical sectional view of a prior art dryer of this type.

An upright drying chamber 1 is provided with a U-shaped belt guide 2. An endless toothed conveyer belt 3 is stretched along the belt guide 2 and around a toothed drive pulley 4 and a plurality of toothed follower pulleys 5. Part of the conveyer belt 3 hangs in the U-shaped belt guide 2 under its own weight so as to remain in contact with the belt guide. With the rotation of the drive pulley 4, the conveyer belt 3 circulates with part of it kept in contact with the belt guide 2.

Inside of the U-shaped belt guide 2 and in the center thereof is provided an upright duct 8 having a plurality of ports 7 for jetting air against the entire surface of that portion of the conveyer belt 3 which is in contact with the belt guide 2.

The duct 8 is connected to a blower 10 via an air inlet 11 and an air circulation duct having a heater 9 therein. The blower 10 receives atmospheric air through an air inlet 13 and a filter 12 and has the function of air flow adjustment. The blower 10 also receives recirculated dry air from a circulation port 14 after it was used to dry the surface of the photosensitive material transported on the conveyer belt 3 so that thermal energy can effectively be recycled.

In operation, a web of photosensitive material A such as a developed film or printed paper under the finishup process is inserted into the drying chamber 1 through an upper inlet 15. The material is then placed on the conveyer belt 3 in contact with the belt guide 2 and is pressed against the surface of the conveyer belt 3 under the pressure of air blown out of the duct 8. With the movement of the conveyer belt, the material, while being dried, descends, turns its moving direction at the bottom, and then ascends. Finally, the dried material A is carried to the following step which is a cutter unit 16 installed above the drying chamber 1.

What is claimed is:

1. A dryer for a web of photosensitive material comprising a drying chamber, a U-shaped belt guide mounted in said drying chamber, an endless conveyor belt guided to run along and in contact with the inner side of said U-shaped belt guide for transporting said web of photosensitive material, and a drying air duct arranged within said U-shaped belt guide and formed with a plurality of air outlets for blowing dry air against the surface of said web to hold said web in contact with said conveyor belt and to dry said web.

2. The dryer as claimed in claim 1, further an air circulation duct connected to said drying air duct, a blower circulating air through said circulation duct, and a heater positioned in said circulation duct.

3. The dryer as claimed in claim 1, wherein said conveyor belt hangs down by its own weight against said inner side of said belt guide.

* * * * *